US008330684B2

(12) United States Patent
Park et al.

(10) Patent No.: US 8,330,684 B2
(45) Date of Patent: Dec. 11, 2012

(54) ORGANIC LIGHT EMITTING DISPLAY AND ITS DRIVING METHOD

(75) Inventors: Young-jong Park, Suwon-si (KR); June-young Song, Suwon-si (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 748 days.

(21) Appl. No.: 11/905,147

(22) Filed: Sep. 27, 2007

(65) Prior Publication Data

US 2008/0246701 A1 Oct. 9, 2008

(30) Foreign Application Priority Data

Feb. 2, 2007 (KR) ..... 10-2007-0011237

(51) Int. Cl.
*G09G 3/32* (2006.01)

(52) U.S. Cl. ..... 345/82; 345/83; 345/84; 345/87; 345/90; 345/690

(58) Field of Classification Search ..... None
See application file for complete search history.

(56) References Cited

U.S. PATENT DOCUMENTS 4,481,511 A * 11/1984 Hanmura et al. ..... 345/100
5,343,215 A 8/1994 Tanaka
6,160,592 A 12/2000 Yoon
6,278,436 B1 8/2001 Hosoi et al.
6,473,065 B1 10/2002 Fan
6,583,775 B1 6/2003 Sekiya et al.
6,850,214 B2 * 2/2005 Nishitani et al. ..... 345/87
6,980,180 B2 12/2005 Hasagawa
7,102,161 B2 9/2006 Inukai
7,123,220 B2 10/2006 Hanari et al.
7,164,401 B2 1/2007 Kwon
7,205,965 B2 4/2007 Mikami et al.

(Continued)

FOREIGN PATENT DOCUMENTS

CN 1418008 A 5/2003

(Continued)

OTHER PUBLICATIONS

*Office action* from the Korean Intellectual Property Office issued in Applicant's corresponding Korean Patent Application No. 10-2007-0011237 dated Feb. 19, 2008.

(Continued)

*Primary Examiner* — Sumati Lefkowitz
*Assistant Examiner* — Jesus Hernandez
(74) *Attorney, Agent, or Firm* — Robert E. Bushnell, Esq.

(57) ABSTRACT

In an organic light emitting display and its driving method, a pixel portion includes a plurality of pixels which express images corresponding to a scan signal, an emission control signal, and a data signal. A scan driver transfers the scan signal and the emission control signal to the pixel portion. A data driver generates and transfers a plurality of data signals to the pixel portion using video data. A frame memory stores and transfers the video data in frame periods to the data driver. A luminance controller determines a pulse of the emission control signal using frame data, which is a sum of video data stored in the frame memory. A power supply unit supplies voltages of first and second power sources to the pixel portion. The luminance controller determines the number and widths of pulses in the emission control signal corresponding to a sum of the video data.

11 Claims, 4 Drawing Sheets

U.S. PATENT DOCUMENTS

| | | | | |
|---|---|---|---|---|
| 7,227,517 | B2 | 6/2007 | Imamura | |
| 7,256,774 | B1 | 8/2007 | Senda et al. | |
| 7,259,735 | B2 | 8/2007 | Kasai | |
| 7,317,433 | B2 | 1/2008 | Chen et al. | |
| 7,355,459 | B2 | 4/2008 | Miyazawa | |
| 7,365,719 | B2 | 4/2008 | Miyagawa | |
| 2002/0011978 | A1 | 1/2002 | Yamazaki et al. | |
| 2002/0024054 | A1 | 2/2002 | Koyama et al. | |
| 2002/0057234 | A1 | 5/2002 | Ishizuka et al. | |
| 2003/0025718 | A1 | 2/2003 | Mori | |
| 2003/0030655 | A1 | 2/2003 | Ooe et al. | |
| 2003/0067424 | A1 | 4/2003 | Akimoto et al. | |
| 2003/0085905 | A1 | 5/2003 | Mori et al. | |
| 2003/0210256 | A1 | 11/2003 | Mori et al. | |
| 2004/0108998 | A1* | 6/2004 | Imamura | 345/204 |
| 2004/0113873 | A1 | 6/2004 | Shirasaki et al. | |
| 2004/0160168 | A1 | 8/2004 | Lee et al. | |
| 2004/0201482 | A1 | 10/2004 | Pedoeem et al. | |
| 2004/0263506 | A1 | 12/2004 | Koyama et al. | |
| 2005/0007319 | A1 | 1/2005 | Shin et al. | |
| 2005/0024351 | A1 | 2/2005 | Sano | |
| 2005/0046619 | A1 | 3/2005 | Senda et al. | |
| 2005/0052369 | A1 | 3/2005 | Tada | |
| 2005/0057580 | A1 | 3/2005 | Yamano et al. | |
| 2005/0057581 | A1 | 3/2005 | Horiuchi et al. | |
| 2005/0068271 | A1 | 3/2005 | Lo | |
| 2005/0083268 | A1 | 4/2005 | Mori et al. | |
| 2005/0116903 | A1 | 6/2005 | Shin | |
| 2005/0206591 | A1 | 9/2005 | Wang et al. | |
| 2005/0212787 | A1 | 9/2005 | Noguchi et al. | |
| 2005/0243076 | A1 | 11/2005 | Kim et al. | |
| 2005/0243077 | A1 | 11/2005 | Chung et al. | |
| 2005/0243223 | A1 | 11/2005 | Slobodin | |
| 2005/0253791 | A1 | 11/2005 | Shin | |
| 2006/0071888 | A1* | 4/2006 | Lee et al. | 345/82 |
| 2006/0101293 | A1 | 5/2006 | Chandley et al. | |
| 2006/0267881 | A1 | 11/2006 | Jeon et al. | |
| 2007/0152934 | A1 | 7/2007 | Maeda | |

FOREIGN PATENT DOCUMENTS

| | | |
|---|---|---|
| CN | 1577451 | 2/2005 |
| JP | 11-024631 | 1/1999 |
| JP | 2000-221944 | 8/2000 |
| JP | 2000-259110 | 9/2000 |
| JP | 2001-060076 | 3/2001 |
| JP | 2002-132218 | 5/2002 |
| JP | 2002-351402 | 12/2002 |
| JP | 2003-228328 | 8/2003 |
| JP | 2003-228331 | 8/2003 |
| JP | 2003-255884 | 9/2003 |
| JP | 2003-280589 | 10/2003 |
| JP | 2003-330418 | 11/2003 |
| JP | 2004-029755 | 1/2004 |
| JP | 2004-287118 | 10/2004 |
| JP | 2004-294752 | 10/2004 |
| JP | 2004-309810 | 11/2004 |
| JP | 2005-055726 | 3/2005 |
| JP | 2006-30516 | 2/2006 |
| JP | 2006-178364 | 7/2006 |
| JP | 2006-276718 | 10/2006 |
| JP | 2007-298778 | 11/2007 |
| KR | 10-2005-0037126 | 4/2005 |
| KR | 10-2005-0085309 | 8/2005 |
| KR | 10-2006-0046635 | 5/2006 |
| KR | 10-2006-0104855 | 10/2006 |
| WO | 03/058593 | 7/2003 |
| WO | 2004/023446 | 3/2004 |
| WO | 2005/006291 | 1/2005 |

OTHER PUBLICATIONS

Bird, Engineering Mathematics, 1989, Newnes, Fourth Edition, p. 319, which was cited in the office action (Paper No. 20100222) mailed Mar. 3, 2010 of the related U.S. Appl. No. 11/365,829.

The Office Action issued Oct. 27, 2009 in U.S. Appl. No. 11/374,122 which was cited in the Information Disclosure Statement filed on Feb. 5, 2010 of the related U.S. Appl. No. 11/365,829.

The Japanese Office Action issued Sep. 15, 2009 in Japanese Application No. 2006-079025, which was cited in the Information Disclosure Statement filed on Nov. 17, 2009 of the related U.S. Appl. No. 11/365,829.

The Chinese Office Action dated May 22, 2009 for Application No. 200610073813.9, which was cited in the Information Disclosure Statement filed on Aug. 17, 2009 of the related U.S. Appl. No. 11/365,829.

The Chinese Office Action mailed Jun. 13, 2008 in Application No. 200610073813.9, which was cited in the Information Disclosure Statement filed on Aug. 21, 2008 of the related U.S. Appl. No. 11/365,829.

The Patent Abstract of Japan, Publication No. 2001-060076, dated Mar. 6, 2001, in the name of Mitsunobu Sekiya et al., which was cited in the Information Disclosure Statement filed on Mar. 26, 2007 of the related Patent No. 7,576,717.

The Patent Abstract of Japan, Publication No. 2000-221944, dated Aug. 11, 2000, in the name of Koji Ogusu et al., which was cited in the Information Disclosure Statement filed on Jun. 19, 2006 of the related Patent No. 7,576,717.

The Notice of Allowance and Allowability (Paper No. 20091217) mailed Jan. 15, 2010 of the related Patent No. 7,719,495.

The Office Action (Paper No. 20100618) mailed Jun. 24, 2010 of the related U.S. Appl. No. 11/365,829.

The Office Action (Paper No. 20100222) mailed Mar. 3, 2010 of the related U.S. Appl. No. 11/365,829.

The Office Action (Paper No. 20091124) mailed Dec. 8, 2009 of the related U.S. Appl. No. 11/365,829.

The Office Action (Paper No. 20090615) mailed Jul. 2, 2009 of the related U.S. Appl. No. 11/365,829.

The Office Action (Paper No. 20090126) mailed Feb. 4, 2009 of the related U.S. Appl. No. 11/365,829.

The Office Action (Paper No. 20101221) mailed Dec. 29, 2010 of the related U.S. Appl. No. 11/374,122.

The Office Action (Paper No. 20090325) mailed Apr. 14, 2009 of the related U.S. Appl. No. 11/374,122.

The Office Action (Paper No. 20081009) mailed Oct. 17, 2008 of the related Patent No. 7,576,717.

* cited by examiner

ORGANIC LIGHT EMITTING DISPLAY AND ITS DRIVING METHOD

CLAIM OF PRIORITY

This application makes reference to, incorporates the same herein, and claims all benefits accruing under 35 U.S.C. §119 from an application for ORGANIC LIGHT EMITTING DISPLAY, AND DRIVING METHOD THE SAME earlier filed in the Korean Intellectual Property Office on 2 Feb. 2007 and there duly assigned Serial No. 2007-0011237.

BACKGROUND OF THE INVENTION

Field of the Invention

The present invention relates to an organic light emitting display, and its driving method, and more particularly, the present invention relates to an organic light emitting display and its driving method, which determine a limit width of luminance corresponding to a sum of data inputted to a pixel portion in order to reduce power consumption and improve image quality.

Discussion of Related Art

Recently, various flat plate displays capable of reducing weight and volume that are disadvantages of Cathode Ray Tubes (CRTs) have been developed. In particular, an organic light emitting display device having excellent emission efficiency, luminance, viewing angle, and high speed response, has been highlighted.

An organic light emitting display uses an Organic Light Emitting Diode (OLED). The OLED includes an anode electrode, a cathode electrode, and an organic emission layer. The organic emission layer is disposed between the anode electrode and the cathode electrode, and emits light a combination of electrons and holes.

FIG. 1 is a block diagram of a conventional organic light emitting display. With reference to FIG. 1, the conventional organic light emitting display includes a pixel portion 10, a data driver 20, a scan driver 30, and a power supply unit 40.

A plurality of pixels 11 are arranged in the pixel portion 10. Each of the pixels 11 includes an OLED (not shown). N scan lines S1, S2, S3, . . . , Sn-1, Sn, and m data lines D1, D2, Dm-1, and Dm are respectively arranged in a column direction and a row direction in the pixel portion 10. The N scan lines S1, S2, S3, . . . , Sn-1, Sn transfer a scan signal, and the m data lines D1, D2, Dm-1, and Dm transfers a data signal. The N scan lines S1, S2, S3, . . . , Sn-1, Sn receive a voltage of a first power source ELVDD and are driven in response thereto, and the m data lines D1, D2, Dm-1, and Dm receive a voltage of a second power source ELVSS and are driven in response thereto. Accordingly, in the pixel portion 10, an OLED emits light according to the scan signal, the data signal, the voltage of the first power source ELVDD, and the voltage of the second power source ELVSS to display images.

The data driver 20 supplies a data signal to the pixel portion 10. The data driver 20 is connected to data lines D1, D2, . . . , Dm-1, Dm, and provides the data signal to the pixel portion 10.

The scan driver 30 sequentially outputs a scan signal. That is, the scan driver 30 is connected to the scan lines S1, S2, S3, . . . , Sn-1, Sn, and transfers the scan signal to a special column of the pixel portion 10. The data signal from the data driver 20 is supplied to the special column of the pixel portion to which the scan signal is transferred to display images. When all columns are selected, one frame is completed.

The power supply unit 40 transfers the voltage of the first power source ELVDD and the voltage of the second power source ELVSS to the pixel portion 10, so that an electric current corresponding to the data signal flows through each pixel 10 according to a voltage difference between the first power source ELVDD and a second power source ELVSS. The second power source ELVSS has a voltage less than that of the first power source ELVDD.

As mentioned above, in the conventional organic light emitting display, when there are more pixels 11 displaying images having high luminance than those displaying images having low luminance, a large electric current flows through the pixel portion 10. In contrast to this, when there are more pixels 11 displaying images having low luminance than those displaying images having high luminance, a small electric current flows through the pixel portion 10.

When the large electric current flows through the pixel portion 10, a large load is applied to the power supply unit 40. Accordingly, there is a need for the power supply unit 40 to have a high output.

Accordingly, so as to reduce an output of the power supply unit 40, when a high gradation is expressed by a low electric current, a difference of electric current amounts of respective gradations is small to indicate a small luminance difference. Consequently, a brightness difference of a low gradation and a high gradation is small to reduce the contrast of the organic light emitting display.

SUMMARY OF THE INVENTION

Accordingly, it is an object of the present invention to provide an organic light emitting display and its driving method, which reduces power consumption by limiting an amount of electric current corresponding to a sum of input data during one frame period, and which improves image quality so a user may easily recognize images by increasing the contrast in such a way that a limited width of cognitive images is increased and a limited width of non-cognitive images are reduced.

The foregoing and/or other aspects of the present invention are achieved by providing an organic light emitting display including: a pixel portion, including a plurality of pixels, to express images corresponding to a scan signal, an emission control signal, and a data signal; a scan driver to transfer the scan signal and the emission control signal to the pixel portion; a data driver to generate and transfer a plurality of data signals to the pixel portion using video data; a frame memory to store and transfer the video data in frame periods to the data driver; a luminance controller to control pulses of the emission control signal using frame data, the frame data being a sum of video data stored in the frame memory; and a power supply unit to supply voltages of first and second power sources to the pixel portion; the luminance controller controlling the number and widths of the pulses in the emission control signal in accordance with the sum of the video data. According to a second aspect of the present invention, a method of driving an organic light emitting display expressing images corresponding to a scan signal, a data signal, and an emission control signal is provided, the method including: detecting frame data, the frame data being a sum of video data stored in a frame memory; detecting a limited range in luminance of a pixel portion in accordance with the frame data; and generating the emission control signal in accordance with the limited range in luminance, the number and widths of the pulses in the emission control signal being in accordance with the limited range in luminance.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
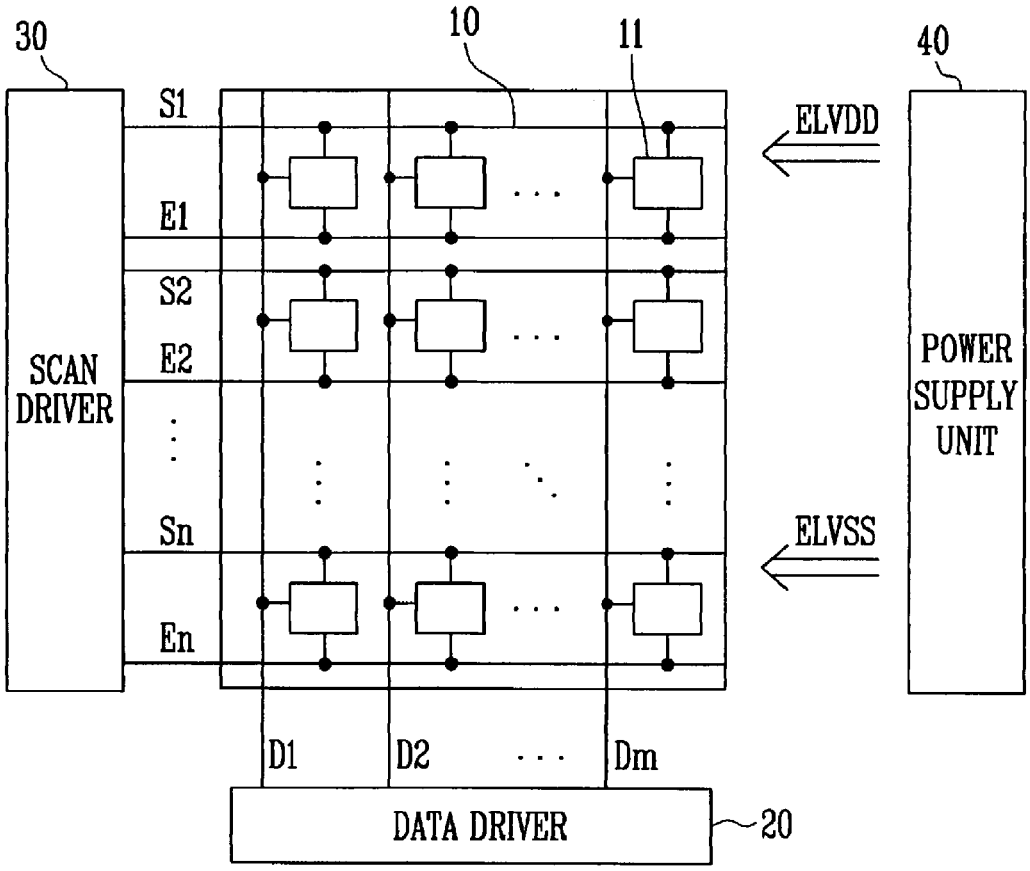
FIG. 1 (PRIOR ART)
FIG. 1 is a block diagram of a conventional organic light emitting display.

Hereinafter, an exemplary embodiment according to the present invention is described with reference to the accompanying drawings. When one element is indicated as being connected to another element, one element may be not only directly connected to another element but also indirectly connected to another element via another element. Furthermore, some elements have been omitted for the sake of clarity. Also, like reference numerals refer to like elements throughout.

Figure 2:
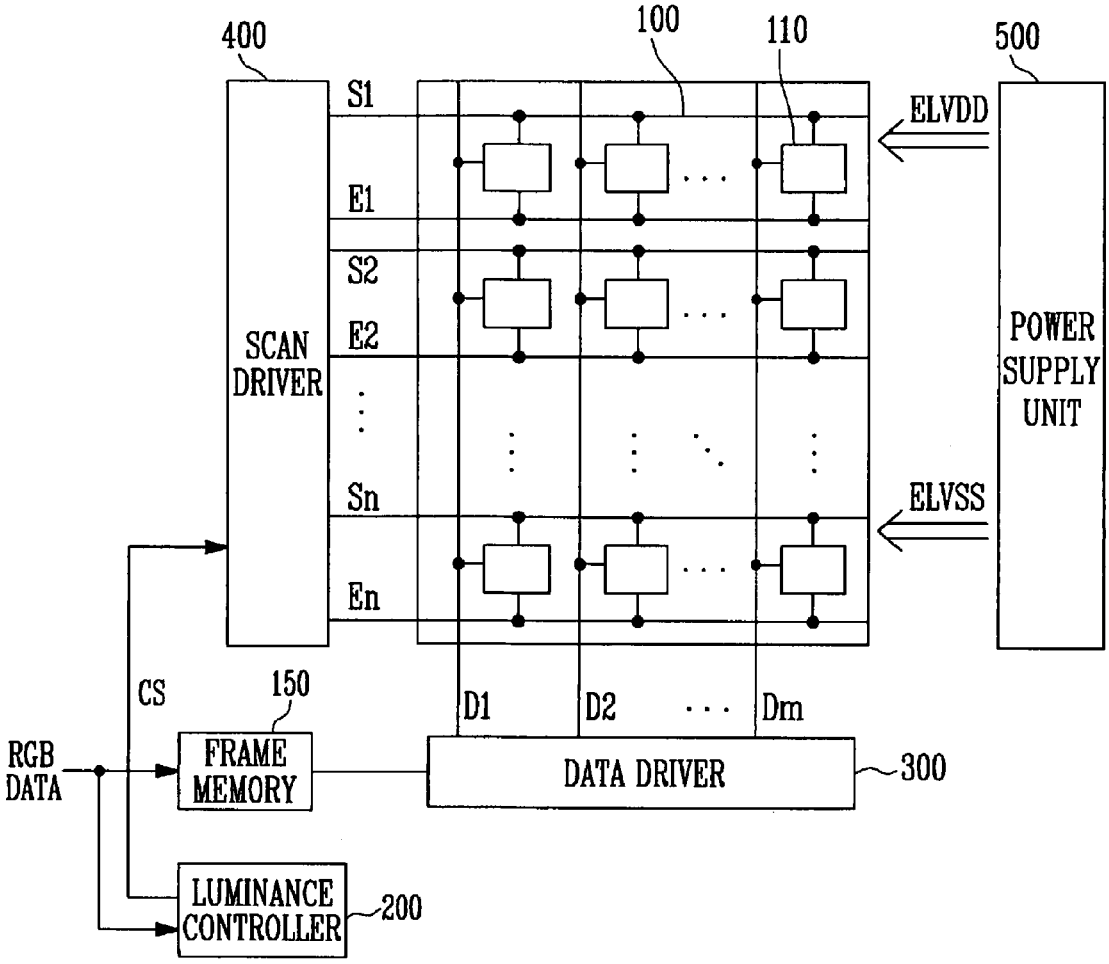
FIG. 2 is a block diagram of an organic light emitting display according to an embodiment of the present invention.
Figure 3A:
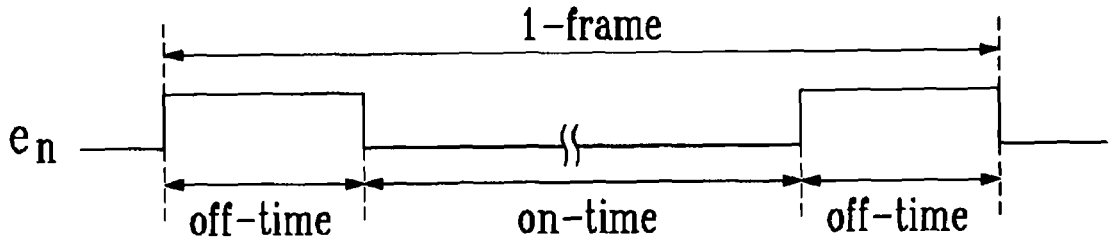
FIG. 3A and FIG. 3B are timing diagrams of an example of an emission control signal of the present invention.
Figure 3B:
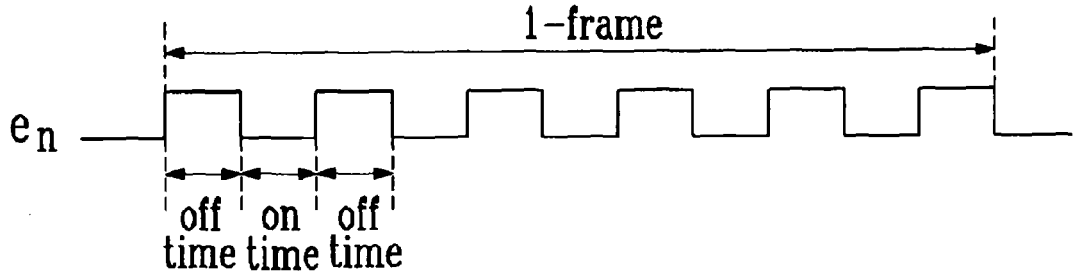

FIG. 2 is a block diagram of an organic light emitting display according to an embodiment of the present invention. FIG. 3A and FIG. 3B are timing diagrams of an example of an emission control signal of an embodiment of the present invention. With reference to FIG. 2, FIG. 3A, and FIG. 3B, the organic light emitting display includes a pixel portion 100, a frame memory 150, a luminance controller 200, a data driver 300, a scan driver 400, and a power supply unit 500.

A plurality of pixels 110 are arranged at the pixel portion 100. Each of the pixels 110 includes an OLED (not shown). N scan lines S1, S2, S3, . . . , Sn-1, Sn and m data lines D1, D2, Dm-1, and Dm are respectively arranged in a column direction and a row direction at the pixel portion 100. The N scan lines S1, S2, S3, . . . , Sn-1, Sn transfer a scan signal, and the m data lines D1, D2, Dm-1, and Dm transfers a data signal. The N scan lines S1, S2, S3, . . . , Sn-1, Sn receive the voltage of the first power source ELVDD and are driven in response thereto, and the m data lines D1, D2, Dm-1, and Dm receive the voltage of the second power source ELVSS and are driven in response thereto. Accordingly, in the pixel portion 100, an OLED emits light according the scan signal, the data signal, the voltage of the first power source ELVDD, and the voltage of the second power source ELVSS to display images.

When a sum of input data is large, since there are many pixels to emit light to a total pixel portion with high luminance, the pixel portion 100 expresses high luminance. In contrast to this, when a sum of input data is small, since there are few pixels to emit light to a total pixel portion with high luminance, the pixel portion 100 expresses low luminance. When the pixel portion 100 emits light with high luminance, dazzling can occur. Since an OLED expresses a luminance according to a current amount, the power consumption becomes significantly high.

A frame memory 150 receives and stores video data transferred to a screen of one frame, and generates a luminance control signal and a data signal using video data stored through the luminance controller 200 and the data driver 300.

The luminance controller 200 limits a luminance of the pixel portion 100 in order to reduce power consumption and to prevent dazzling. The luminance controller 200 detects total luminance of the pixel portion 100 to determine a limit range of luminance. Namely, when total luminance of the pixel portion is high, power consumption is great. Accordingly, when a limit range of the luminance is increased and a total luminance of the pixel portion is low, since power consumption is small, a limit range of the luminance is reduced or the luminance is not limited. When the luminance is high, the limited range of the luminance is great to prevent dazzling.

Furthermore, the luminance controller 200 detects a total amount of video data in order to determine a limited range of luminance. When the total amount of the video data is large, the luminance controller 200 judges that there are many pixels to emit light brightly. In contrast to this, when the total amount of the video data is small, the luminance controller 200 judges that there are few pixels to emit light brightly. Accordingly, the luminance controller 200 outputs a luminance control signal corresponding to a sum of video data inputted during one frame period to determine a limited range of luminance by frames.

Moreover, when a limited range of luminance is determined, the luminance controller 200 controls an emission time of a pixel to reduce an amount of an electric current flowing through the pixel. Accordingly, when a limited range of the luminance of the pixel portion 100 is small or the luminance of the pixel potion 100 is not limited, an emission time of the pixel is long maintained, the contrast of an emission pixel and a non-emission pixel is increased to improve the contrast of the pixel portion 100.

The luminance controller 200 controls a pulse width of an emission control signal, which is transferred thereto through emission control lines E1, E2, En-1, En in order to adjust an emission time of the pixel portion 100. The luminance controller 200 receives a luminance control signal from the scan driver 400 and controls the pulse width of the emission control signal based on the received luminance control signal. When the pulse width of the emission control signal is great, an emission time of the pixel is long to cause a large electric current to flow. In contrast to this, when the pulse width of the emission control signal is small, an emission time of the pixel is short to cause a small electric current to flow. However, where limiting a luminance using the emission time, when the pixel portion expresses high luminance, since a non-emission time period is long maintained during one frame period, a user recognizes a flickering of the screen during the non-emission period. The flickering of the screen is called flicker. When a limited range of luminance is small, since the non-emission period is short, the user does not recognize it. Accordingly, in this case, the flicker does not affect the display. Consequently, when the limited range of luminance is large, the flicker can become a significant problem.

Accordingly, so as to solve the problem, the emission control signal is transferred in a plurality of pulse patterns. When the limited range of the luminance is small, the emission control signal is formed as shown in FIG. 3A. Furthermore, when the limited range of the luminance is large, the emission control signal is formed as shown in FIG. 3B. The length and the number of non-emission times between the emission times are determined according to the limited range of luminance. When the length of the non-emission times is not long, the user does not notice the flicker.

The data driver 300 supplies the data signal to the pixel portion 100. The data driver 300 receives video data having red, green, and blue components from a frame memory 150, and generates a data signal. The data driver 300 is connected to the data lines D1, D2, . . . , Dm-1, Dm, and provides the generated data signal to the pixel portion 100.

The scan driver 400 supplies a scan signal and an emission control signal to the pixel portion 100. The scan driver 400 is connected to the scan lines S1, S2, . . . , Sn-1, Sn, and the emission signal lines E1, E2, . . . , En-1, En, and transfers the scan signal and the emission control signal to a specific column of the pixel portion 100. A data signal outputted from the data driver 300 is transferred to the pixel 110 to which the scan signal is transferred. The pixel 110 to which the emission control signal is transferred emits light according to the emission control signal.

Furthermore, the data signal from the data driver 300 is supplied to a specific column of the pixel portion 100 to which the scan signal is transferred. A transfer time of an electric current corresponding to the data signal to the OLED is determined by a pulse width of the emission control signal to adjust an emission time of the OLED. The emission control signal is formed based on the luminance control signal generated by the luminance controller. The pulse number and length of the emission control signal depend on the luminance control signal.

Furthermore, the scan driver 400 may include a scan driving circuit and an emission driving circuit. The scan driving circuit generates the scan signal, and the emission driving circuit generates the emission control signal. The scan driving circuit and the emission driving circuit can be included in one structural element, or can be separate structural elements.

The power supply unit 500 transfers a voltage of a first power source ELVDD and a voltage of a second power source ELVSS to the pixel portion 400 to cause an electric current corresponding to a data signal to flow to each pixel due to a difference between the voltage of the first power source ELVDD and the voltage of the second power source ELVSS. When a sum of video data supplied thereto during one frame is large, a limited range of luminance is large to not significantly increase power consumption. As a result, power consumption is reduced.

Figure 4:
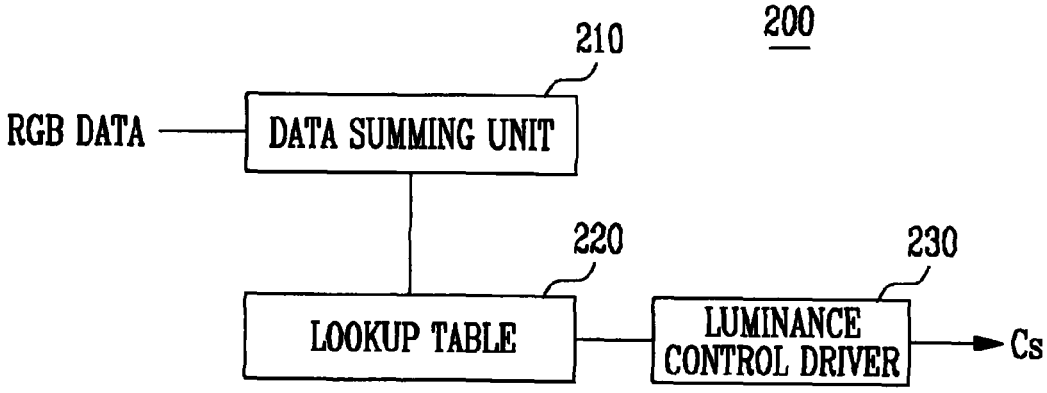
FIG. 4 is a block diagram of an example of a luminance controller used in the organic light emitting display according to an embodiment of the present invention.

FIG. 4 is a block diagram of an example of a luminance controller 200 used in the organic light emitting display according to the present invention. Referring to FIG. 4, the luminance controller includes a data summing unit 210, a look-up table 220, and a luminance control driver 230.

The data summing unit 210 obtains a sum of video data stored in the frame memory 150, and sums up a gradation value of the video data stored in the frame memory. The gradation value of the video data is referred to as 'frame data'. When the summed frame data from the data summing unit 210 is large, it is judged that there are many pixels emitting light with a high luminance. In contrast to this, when the summed frame data from the data summing unit 210 is small, it is judged that there are few pixels emitting light with high luminance. Furthermore, a limited range of luminance is determined by a sum of the video data.

The look-up table 220 stores the number and widths of pulses in an emission control signal, and the intervals between the pulses. The emission control signal is formed according to a limited range of luminance detected by a sum of video summed by the data summing unit 210. Moreover, so as to reduce a size of the look-up table 220, the limited range of luminance can be designated using a partial bit of the video data.

The luminance control driver 230 generates a luminance control signal corresponding to the number and widths of pulses in an emission control signal, and the intervals between the pulses, which are designated according to the limited range of luminance. When the luminance control signal is inputted to the scan driver 400, the scan driver 400 generates an emission control signal corresponding to the luminance control signal.

Figure 5:
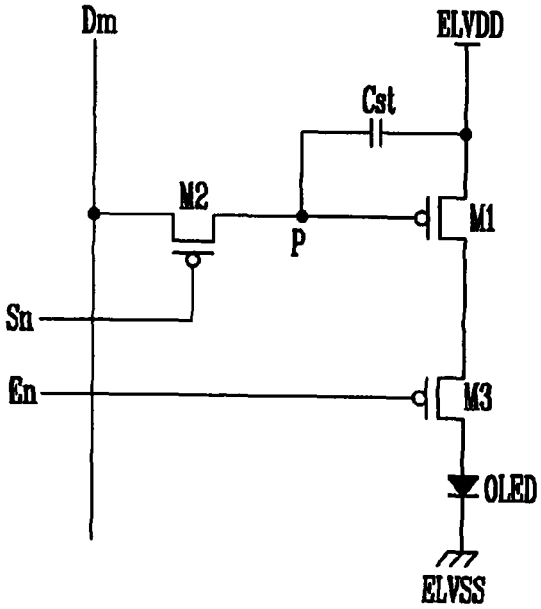
FIG. 5 is a circuit diagram of an example of a pixel used in the organic light emitting display of FIG. 2.

FIG. 5 is a circuit diagram of an example of a pixel used in an organic light emitting display shown in FIG. 2. With reference to FIG. 5, the pixel includes a first transistor M1, a second transistor M2, a third transistor M3, a capacitor Cst, and an OLED.

A source of the first transistor M1 is connected to the first power source ELVDD, a drain thereof is connected to a source of the third transistor M3, and a gate thereof is connected to a first node N1. A source of the second transistor M2 is connected to a data line Dm, a drain thereof is connected to the first node N1, and a gate thereof is connected to the scan line Sn. A source of the third transistor M3 is connected to a drain of the first transistor M1, a drain thereof is connected to an anode electrode of the OLED, and a gate electrode thereof is connected to an emission control line En. A first electrode of the capacitor Cst is connected to the first power source ELVDD and a second electrode thereof is connected to the first node N1. Furthermore, the OLED includes an anode electrode, a cathode electrode, and an emission layer. The anode electrode of the OLED is connected to the drain of the third transistor M3 and a cathode electrode thereof is connected to the second power source ELVSS. The emission layer is disposed between the anode electrode and the cathode electrode. When an electric current flows from the anode electrode to the cathode electrode, the emission layer emits light.

In an operation of the pixel, when the scan signal transitions to a low state, so that the second transistor M2 is turned on, a data signal transferred through the data line Dm is provided to the first node N1. Accordingly, the data signal is transferred to the second electrode of the capacitor Cst. A voltage of the first power source ELVDD has been transferred to the first electrode of the capacitor Cst. Furthermore, when the scan signal transitions to a high state, so that the second transistor M2 is turned off, a floating state occurs between the first node N1 and the data line Dm. A voltage of the first node N1 maintains a voltage of the data signal by the capacitor Cst. Moreover, a voltage of the first node N1 is transferred to the gate of the first transistor M1, so that an electric current corresponding to the voltage of the first node N1 flows from a source of the first transistor M1 to a drain side thereof. The third transistor M3 is turned off according to the emission control signal. When the third transistor M3 is turned off according to the emission control signal, an electric current transferred to the OLED is cut off, so that the OLED can not emit light. When the third transistor M3 is turned on, the electric current flows to the OLED, so that the OLED emits light. The emission control signal is transferred in various patterns according to the limited range of luminance to prevent flicker and to reduce power consumption.

As is seen from the forgoing description, in the organic light emitting display and its driving method according to an embodiment of the present invention, power consumption is reduced and the contrast is enhanced. Furthermore, an emission time and a non-emission time are controlled to prevent flicker from occurring.

Although an embodiment of the present invention has been shown and described, it would be appreciated by those skilled in the art that modifications might be made to this embodiment without departing from the principles and spirit of the present invention, the scope of which is defined by the following claims.

What is claimed is:

1. An organic light emitting display comprising:

a pixel portion, including a plurality of pixels, to express images corresponding to a scan signal, an emission control signal, and a data signal;

a scan driver to transfer the scan signal and the emission control signal to the pixel portion;

a data driver to generate and transfer a plurality of data signals to the pixel portion using video data;

a frame memory to store only one frame of video data and transfer the video data in frame periods to the data driver;

a luminance controller to control pulses of the emission control signal using frame data, the frame data being a sum of video data stored in the frame memory; and a power supply unit to supply voltages of first and second power sources to the pixel portion;

wherein the luminance controller controls the number and widths of the pulses of the emission control signal in accordance with the sum of the video data and controls an emission time and a non-emission time of the pixel portion according to a range of luminance of the pixel portion, when the range of luminance is below a predetermined value the emission time and non-emission time of the pixel portion are increased, decreasing the number of pulses of the emission control signal and increasing the width of the pulses of the emission control signal, and when the range of luminance is above the predetermined value the emission time and non-emission time of the pixel portion are decreased, increasing the number of pulses of the emission control signal and decreasing width of the pulses of the emission control signal, wherein both the increase of the emission time and non-emission time of the pixel portion and the decrease of the emission time and non-emission time of the pixel portion are accomplished using the luminance controller, said luminance controller being a single driver circuit consisting solely of a data summing unit, a look-up table and a luminance control signal driver, wherein the video data includes red, green, and blue components, wherein the data summing unit sums the video data stored in the frame memory to generate the frame data, wherein the look-up table designates the number and widths of pulses in the emission control signal corresponding to the video data, and wherein the luminance control signal driver generates a luminance control signal in accordance with the number and widths of the pulses in the emission control signal.

2. The organic light emitting display as claimed in claim 1, wherein an emission time of each pixel is determined by the pulses of the emission control signal.

3. The organic light emitting display as claimed in claim 1, wherein the emission time of each pixel is reduced corresponding to a size of the frame data, and wherein frame data of a size that exceeds a predetermined value has a shorter pixel emission time than of that of frame data of a size that is less than the predetermined value.

4. The organic light emitting display as claimed in claim 1, wherein the pixel portion emits light at least once in accordance with a size of the frame data during one frame period.

5. The organic light emitting display as claimed in claim 1, wherein the scan driver includes a scan driving circuit to generate the scan signal and an emission control driving circuit to generate the emission control signal.

6. The organic light emitting display as claimed in claim 1, wherein a pixel emitting light has a low frequency emission when a size of the frame data is small.

7. A method of driving an organic light emitting display expressing images corresponding to a scan signal, a data signal, and an emission control signal, the method comprising:

detecting frame data, the frame data being a sum of video data stored in a frame memory containing only a single frame of video data;

detecting a limited range in luminance of a pixel portion corresponding to the frame data; and generating the emission control signal according to the limited range in luminance, the number and widths of pulses in the emission control signal being in accordance with the limited range in luminance, wherein an emission time and a non-emission time of the pixel portion is controlled according to a range of luminance of the pixel portion, when the range of luminance is below a predetermined value the emission time and non-emission time of the pixel portion are increased by decreasing the number of pulses of the emission control signal and increasing the width of the pulses of the emission control signal, and when the range of luminance is above the predetermined value the emission time and non-emission time of the pixel portion are decreased by increasing the number of pulses of the emission control signal and decreasing the width of the pulses of the emission control signal, wherein both the increase of the emission time and non-emission time of the pixel portion and the decrease of the emission time and non-emission time of the pixel portion are accomplished using the luminance controller, said luminance controller being a single driver circuit consisting solely of a data summing unit, a look-up table and a luminance control signal driver, wherein the video data includes red, green, and blue components, wherein the data summing unit sums the video data stored in the frame memory to generate the frame data, wherein the look-up table designates the number and widths of pulses in the emission control signal corresponding to the video data, and wherein the luminance control signal driver generates a luminance control signal in accordance with the number and widths of the pulses in the emission control signal.

8. The method as claimed in claim 7, wherein generating the emission control signal is performed using the look-up table, the look-up table stores the number and widths of the pulses in the emission control signal in accordance with a sum of the video data.

9. The method as claimed in claim 7, wherein an emission time of the pixel portion is in accordance with the pulses of the emission control signal.

10. The method as claimed in claim 9, wherein the emission time of the pixel portion is reduced in accordance with a size of the frame data, and wherein frame data of a size that exceeds a predetermined value has a shorter pixel emission time than of that of frame data of a size that exceeds a predetermined value.

11. The method as claimed in claim 7, wherein the pixel portion emits light at least once in accordance with a size of the frame data during one frame period.

* * * * *